US011441328B2

(12) United States Patent
Swensson

(10) Patent No.: US 11,441,328 B2
(45) Date of Patent: Sep. 13, 2022

(54) PERFORATED FENCING

(71) Applicant: Animex International Ltd, Knowle (GB)

(72) Inventor: Dean Swensson, Southampton (GB)

(73) Assignee: Ecosupport Limited, Hampshire (GB)

( * ) Notice: Subject to any disclaimer, the term of this patent is extended or adjusted under 35 U.S.C. 154(b) by 426 days.

(21) Appl. No.: 16/020,081

(22) Filed: Jun. 27, 2018

(65) Prior Publication Data

US 2019/0003203 A1 Jan. 3, 2019

(30) Foreign Application Priority Data

Jun. 28, 2017 (GB) ..... 1710301

(51) Int. Cl.
*E04H 17/16* (2006.01)

(52) U.S. Cl.
CPC ..... *E04H 17/16* (2013.01)

(58) Field of Classification Search
CPC ..... E04H 17/16; E04H 17/04; E04H 17/003; E04H 17/18; E01F 7/00; E01F 7/02; E01F 7/025; E01F 7/04; E01F 11/1855; E01F 11/1857; A01K 15/006; A01K 15/04; E02B 3/04; E02D 17/20; E02D 17/207; E04F 11/1855; E04F 11/1857
USPC ..... 256/31, 11, 26
See application file for complete search history.

(56) References Cited

U.S. PATENT DOCUMENTS 4,823,822 A * 4/1989 Maya ..... E04H 15/58 135/19.5
5,184,800 A * 2/1993 Tabler ..... E01F 7/02 256/12.5
6,481,259 B1 * 11/2002 Durney ..... E02D 17/202 72/324
7,174,617 B2 * 2/2007 Wright ..... E04H 17/16 256/1
7,562,453 B1 * 7/2009 Benner ..... A01G 13/10 256/1
7,901,160 B2 * 3/2011 D'Andreta ..... B32B 5/22 405/302.6
8,100,609 B2 * 1/2012 Wilson ..... E02D 17/20 405/302.6
8,308,141 B1 * 11/2012 Mellins ..... E04H 17/163 256/25
8,465,231 B2 * 6/2013 Christopher ..... E02B 3/04 405/302.7
8,747,027 B1 * 6/2014 Singleton ..... E02D 3/005 405/302.7
2002/0172564 A1 * 11/2002 Brown ..... E01F 7/025 405/302.6
2008/0179577 A1 * 7/2008 Neusch ..... E04H 17/161 256/24
2009/0321698 A1 * 12/2009 Payne ..... E04H 17/16 256/31

(Continued)

*Primary Examiner* — Michael P Ferguson
*Assistant Examiner* — Kevin J Baynes
(74) *Attorney, Agent, or Firm* — Bay State IP, LLC

(57) ABSTRACT

A fence comprising one or more fencing panels with corresponding supports, each fencing panel has perforations, and each fencing panel is scored at least once enabling the folding of one or more portions. The perforations allow for the flow of water, whilst inhibiting the access of small typically endangered, animals to a site. Scoring the fence allows for a lip or lips to be formed on the fence and to further inhibit animal movement.

5 Claims, 3 Drawing Sheets

(56) References Cited

U.S. PATENT DOCUMENTS

| | | | | |
|---|---|---|---|---|
| 2010/0123112 | A1* | 5/2010 | Kahtani | E01F 7/02 256/12.5 |
| 2011/0227753 | A1* | 9/2011 | Iffergan | G02B 6/4432 340/850 |
| 2015/0041742 | A1* | 2/2015 | Xu | E04H 17/16 256/24 |

* cited by examiner

PERFORATED FENCING

CROSS REFERENCE TO RELATED APPLICATION

This application takes priority from and claims the benefit of United Kingdom Patent Application 1710301.1 filed on Jun. 28, 2017, the contents of which are herein incorporated by reference.

BACKGROUND OF THE INVENTION

Field of the Invention

The present invention relates to a fence, or panels thereof, particularly, but limited for use on construction sites.

Description of the Related Art

Currently, it is not uncommon to have three fences at a construction site. A first fence for the mitigation of soil erosion, this may be related to controlling water flow. A second fence for the exclusion of workers and other personnel from certain areas. In the USA and Canada, for example, such an exclusion fence is normally orange, and known as Environmentally Sensitive Area Fencing. A third fence may also be employed for the exclusion of animals, particularly protected species, from the construction site.

SUMMARY OF THE INVENTION

The object of the present invention is to provide fencing suitable for the mitigation of soil erosion, restriction of human access to certain areas, and the exclusion of animals.

According to the invention there is provided a fence, comprising:

one or more fencing panels, and one or more support posts for supporting the fencing panels, and each fencing panel having perforations, and each fencing panel being scored at least once enabling the folding of one or more portions.

Normally, each fencing panel may overlap one or more adjacent fencing panels. Preferably, the overlapping sections are supported by a support post, wherein fastening means may be used to secure the fencing panels together, and to the support post.

It is envisaged that the fastening means may be any suitable means, particularly but not limited to pins, screws, tags, wires, cable ties or clips. Preferably, anti-climb washers and fixings will be used. If wires, cable ties or other similar means are used, it is envisaged that the hole through which the fastening means is attached is appropriately sized to take expansion and contraction of the fastening means into account.

It is envisaged that each fencing panel will be scored at least once. Preferably, each fencing panel is scored three times. Alternatively, each fencing panel may be scored twice, four times, or more. As well as being scored, the panel may have demarcation lines for distinguishing different regions of each fencing panel.

Normally the scoring will section each fencing panel into 4 regions. The section between the bottom of the fence panel and the bottom score forming a bottom lip. The next section between the bottom score and a lower score/demarcation being perforated, and referred to henceforth as the lower region. Between the lower score and top score each panel is perforated, henceforth referred to as the upper region. The area between the top score and the top of the fence forming the optional top lip.

Normally the bottom lip is between 50 mm and 150 mm in height. Preferably, the bottom lip is between 75 mm to 125 mm in depth. It is envisaged that the bottom lip will be substantially 100 mm.

Normally, the lower score/demarcation is positioned to render the lower regions as between 100 mm and 300 mm in depth. Preferably, the lower region is 150 mm to 250 mm in height. It is envisaged that the lower region will be substantially 200 mm in depth.

Normally, the top score is positioned to render the upper region as between 515 mm and 715 mm in depth. Preferably, the upper region is between 565 mm and 665 mm in depth. It is envisaged that the upper region will normally be substantially 615 mm in depth.

Normally, the top lip between the top score and the upper end of the fence is between 50 mm and 150 mm in height. Preferably, the top lip is between 75 mm to 125 mm in depth. It is envisaged that the bottom lip will be substantially 100 mm.

Both the upper and lower regions of each fencing panel comprise perforations. Normally, the perforations are disposed in offset rows, alternatively, the perforations could be more uniformly positioned. It is envisaged that the perforations in the upper and lower regions could be of similar distances to one another, or with larger spacing between perforations in the upper region, such that there is a lower density of perforations in the upper region relative to the lower region.

Normally, each perforation is between 20 mm and 30 mm from the closest perforation horizontally or vertically. Preferably, the perforations are substantially 25 mm apart.

As the rows are offset, the distance between each row and or column is normally 10 mm to 15 mm apart. Preferably, the rows/columns of perforations are substantially 12.5 mm apart.

Normally, the perforations do not extend all the way to the scored line, leaving a buffer area. There may be a distance left of 15 mm to 35 mm, or 20 mm to 30 mm. Preferably, the buffer area will be substantially 25 mm, or 27.5 mm.

The fence is normally between 700 mm and 1500 mm in total height. Preferably, the fence is between 800 mm and 1300 mm in height. Even more preferable is for the fence to be between 900 mm and 1100 mm in height. It is envisaged that the fence will normally be 1015 mm in height.

Preferably the perforations are of a size to allow the flow of water, but not the travel of small animals, such as newts, lizards, salamanders etc. across the barrier. Normally the perforation diameter is 3.175 mm, however it is envisaged that smaller perforations may be used, as well as larger diameter protrusions such as in the range of 2 mm to 4 mm.

Normally, the fencing will be constructed of a durable plastic material. Alternatively a metal or other material may be used. Preferably the material of construction is suitable for extrusion, wherein tooling may be used to score each panel upon extrusion. Alternatively, scoring may take place afterwards.

The fence may be any colour. However, the fence will preferably be orange in accordance with environmentally sensitive area fencing practice. This varies regionally, and as such it is envisaged any colour may be used.

BRIEF DESCRIPTION OF THE DRAWINGS

To help understanding of the invention, a specific embodiment thereof will now be described by way of example and with reference to the accompanying drawings, in which.

DETAILED DESCRIPTION OF THE SEVERAL EMBODIMENTS

Figure 1:
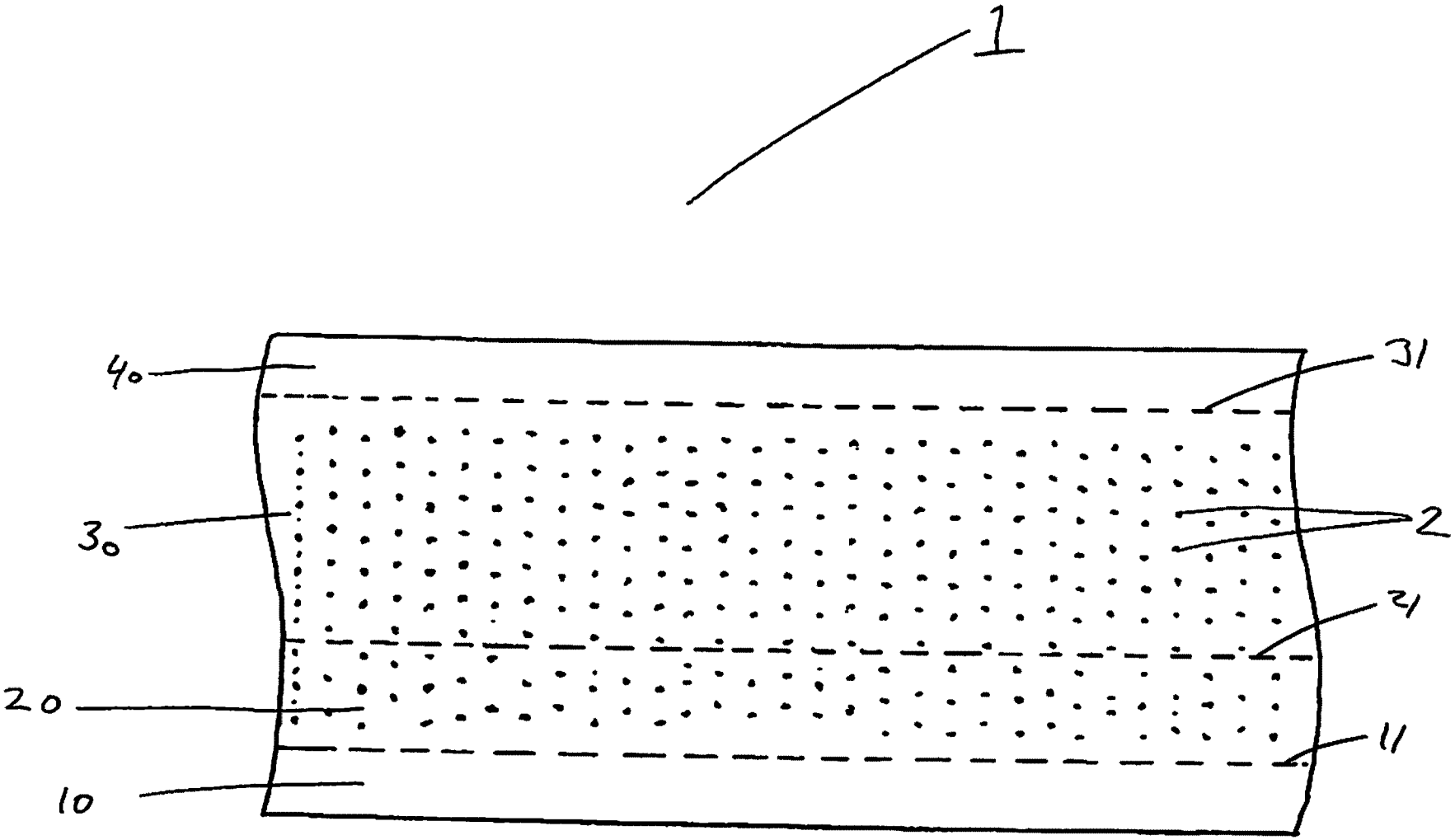
FIG. 1 depicts a front view of a fencing panel in accordance with the present invention.

Referring to FIG. 1, there is provided a frontal view of a fence panel 1. It can be seen that the fencing panel 1 comprises a bottom lip 10, bounded by a bottom score 11 in the fence. The bottom score serves to allow folding/creasing of the fence. A lower region 20 is sectioned by a lower score 21. In the preferred embodiment, the perforations 2 in the lower region are normally 25 mm from the lower score 21. The perforations 2 in the upper region 30 are also preferably 25 mm from the lower score 21, but 27.5 mm from the top score 31. The top score 31 forms the lower boundary of the top lip.

In the preferred embodiment, the perforations 2 are 25 mm vertically and/or horizontally from another perforation. However, the rows/columns of perforations are offset such that the rows/columns are 12.5 mm apart.

Figure 2:
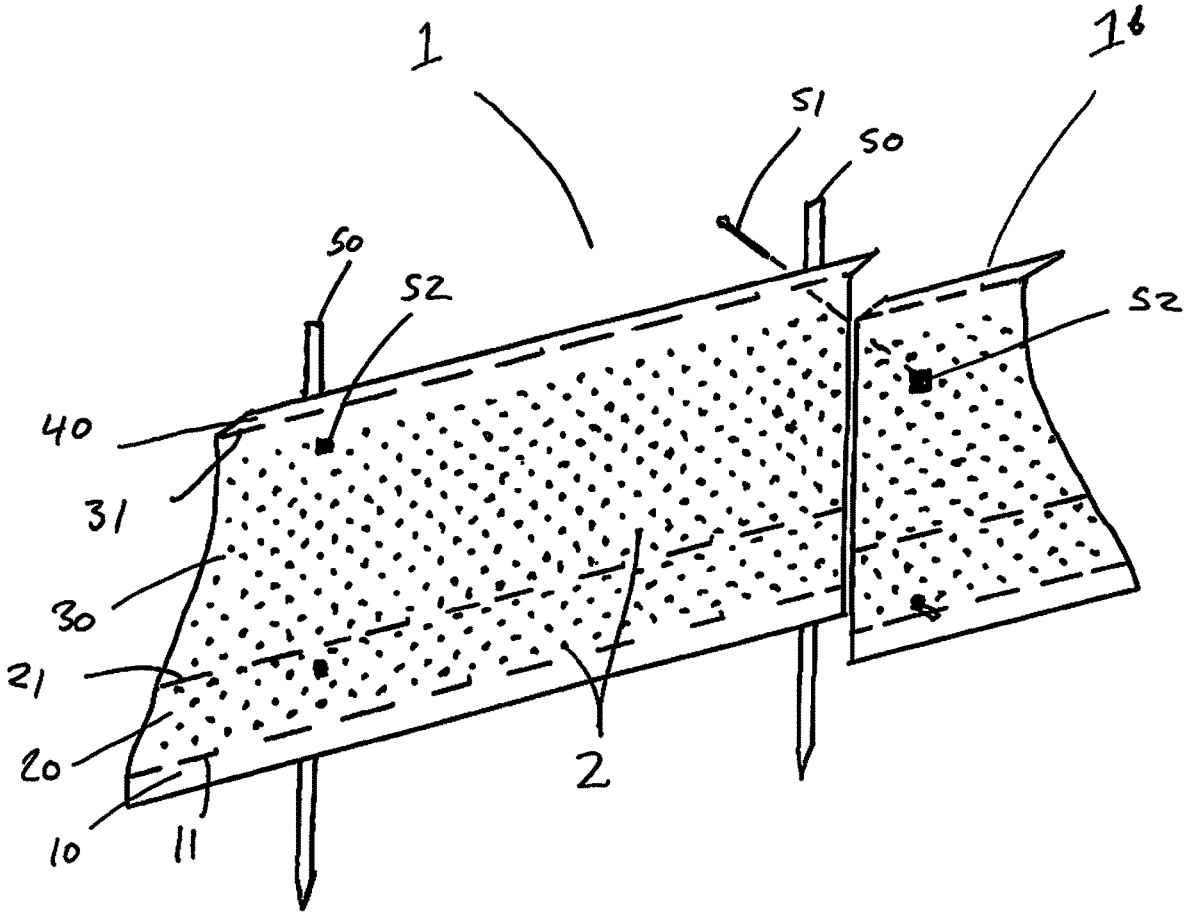
FIG. 2 is an isometric view of the present invention.

Referring to FIG. 2, a pair of fence panels 1 and 1*b* may be seen. Support posts 50 are provided. The fence panels 1, 1*b* are connected to the support post by fastening means comprising of a bolt 51 and washer 52. In the preferred embodiment, the fastening means are adapted to prevent climbing. It can be seen that two fencing panels may overlap, and be fastened by the same fastening means 51, and 52 to the same support post 50. In FIG. 2 it can be seen that the top lip is bent over to reduce the possibility of an animal form being able to climb up and over the fence.

Figure 3:
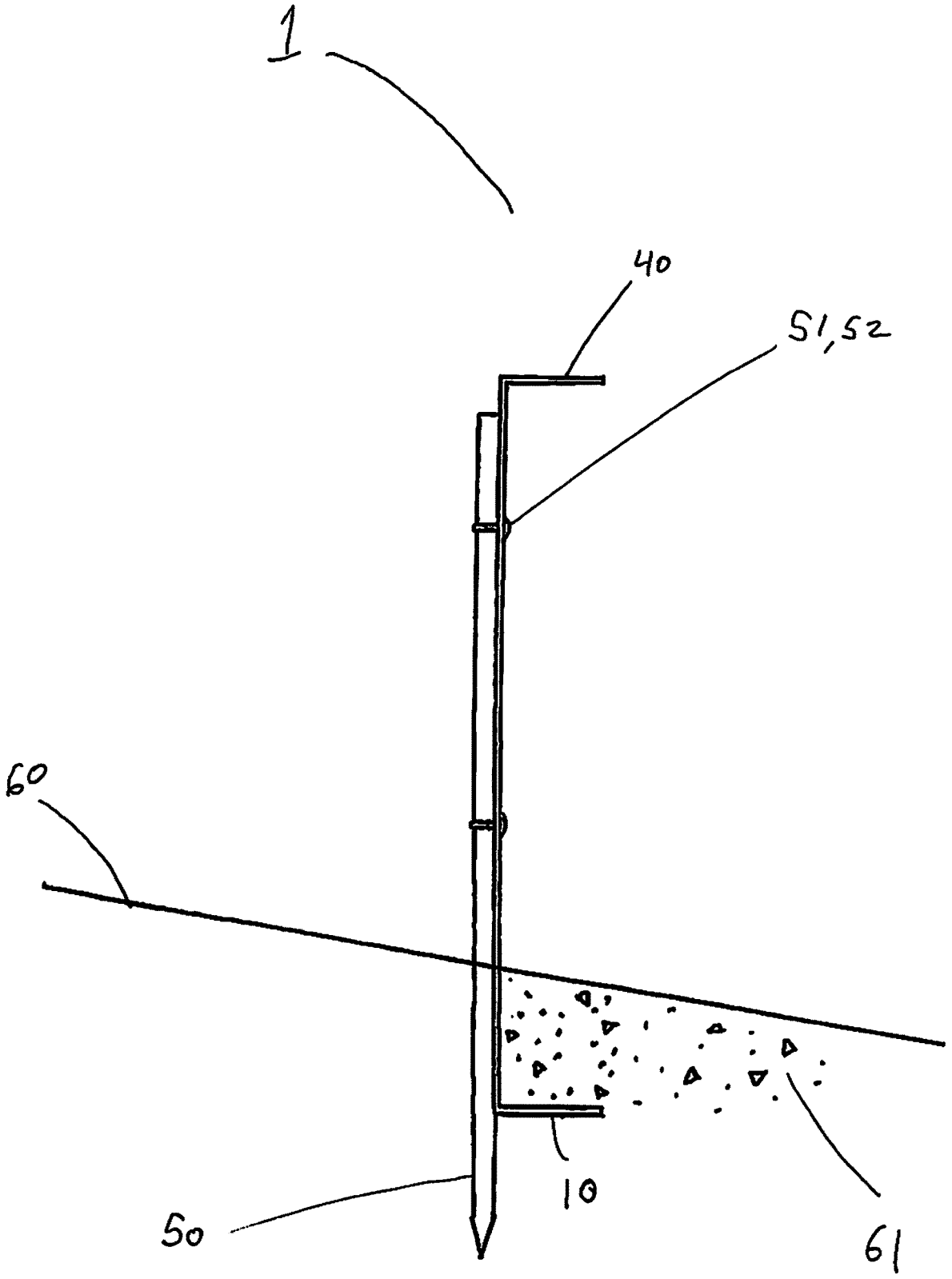
FIG. 3 is a cross sectional view of the present invention.

Referring to FIG. 3, a cross sectional view of the preferred embodiment can be seen. The support post extends beyond the base of the fence panel 1. The bottom lip 10 of the fence panel 1 has been creased along the bottom score to inhibit the ability of animals to burrow through the ground 61 under the fence 1. The perforations (not shown in FIG. 3) enable water to flow along slope 60 through the fencing's perforations. The top lip 40 has been bent to help prevent animals from being able to climb over the barrier.

The lower score 21 is provided so that a larger bottom lip 10 may be made. This is of particular benefit when hard ground conditions mean that a trench is not feasible/practical. In such circumstances, the wider bottom lip may be covered with soil, thereby also preventing burrowing animals from crossing the boundary.

The invention is not intended to be restricted to the details of the above described embodiment. Variations have been given in the description, and any alternative available to an individual of ordinary skill in the art may be utilised. For example, the lower score may be a demarcation line instead of a score. The material of construction is also not intended as a limiting feature.

What is claimed is:

1. A fence comprising:

one or more fencing panels, and one or more support posts for supporting the fencing panels, wherein each fencing panel has perforations, and is scored at least three times enabling the folding of the fence into at least four regions;

wherein three scores are located along a length of each fencing panel, and wherein the at least four regions on each fencing panel are:

a bottom lip between the bottom edge of the fence panel and a bottom score, wherein the bottom lip is free of perforations, a lower region between the bottom score and a lower score, said lower region comprising perforations, an upper region between the lower score and a top score, said upper region comprising perforations, and a top lip between the top score and the top edge of the fence panel, wherein the top lip is free of perforations;

wherein each fencing panel is made of a rigid sheet material;

wherein the fencing panels are connected to the support posts on a rear side of the fencing panels;

wherein the three scores are arranged substantially horizontally along the length of each fencing panel;

wherein the three scores are substantially parallel to one another;

wherein the top lip is bent at the top score in a direction away from the support posts to prevent climbing over the fence;

wherein the bottom lip is bent in a direction away from the support posts such that it is able to be disposed underground and prevent burrowing and digging under the fence; and wherein the lower score allows the bottom lip to be larger when a trench is not feasible due to hard ground conditions.

2. A fence as claimed in claim 1, wherein any one of the following fastening means may be used to secure the support posts to the fencing panels:

anti-climb washers, pins, screws, cable ties, or wires.

3. A fence as claimed in claim 1, wherein the perforations are:

disposed in offset rows with respect to the upper and lower regions, or substantially in line with one another with respect to the upper and lower regions.

4. A fence as claimed in claim 1, wherein the perforations do not extend all the way to the scores, leaving a buffer region around the bottom, the lower, and the top scores.

5. A fence as claimed in claim 1, wherein the perforations are sized to allow the flow of water, but not the travel of animals.

* * * * *